US008353497B2

(12) United States Patent
Trevas

(10) Patent No.: US 8,353,497 B2
(45) Date of Patent: Jan. 15, 2013

(54) VARIABLE RADIUS ANNULAR AND RAM PACKING UNIT AND METHOD

(75) Inventor: David Alexander Trevas, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 870 days.

(21) Appl. No.: 12/334,887

(22) Filed: Dec. 15, 2008

(65) Prior Publication Data

US 2010/0147536 A1 Jun. 17, 2010

(51) Int. Cl.
*E21B 33/06* (2006.01)

(52) U.S. Cl. ..... 251/1.3; 251/1.1; 251/212; 166/84.3; 166/387

(58) Field of Classification Search ..... 251/1.3, 251/251, 257, 261, 1.1; 166/363, 387, 86.3, 166/85.4, 84.3, 191, 202, 203; 277/326, 277/335

See application file for complete search history.

(56) References Cited

U.S. PATENT DOCUMENTS 1,856,512 A * 5/1932 Schofield et al. ..... 251/1.1
1,858,352 A * 5/1932 Young ..... 251/1.1
2,313,177 A * 3/1943 Sprague ..... 251/59
2,504,377 A * 4/1950 Beil ..... 251/1.1
2,812,197 A * 11/1957 Gibson ..... 277/327
2,832,617 A * 4/1958 Gibson ..... 277/327
2,846,178 A * 8/1958 Minor ..... 251/1.2
3,572,627 A * 3/1971 Jones et al. ..... 251/1.2
3,897,038 A * 7/1975 Le Rouax ..... 251/1.2
4,229,012 A * 10/1980 Williams, III ..... 277/325
4,310,139 A * 1/1982 Williams et al. ..... 251/1.2
4,460,151 A * 7/1984 Williams et al. ..... 251/1.2
4,508,311 A * 4/1985 Just et al. ..... 251/1.2
4,657,263 A * 4/1987 Hynes et al. ..... 277/327
5,662,181 A * 9/1997 Williams et al. ..... 175/195
6,367,804 B1 * 4/2002 Watts ..... 277/325
6,955,357 B2 * 10/2005 Griffin et al. ..... 277/325
7,510,002 B2 * 3/2009 Brown et al. ..... 166/84.3
7,565,918 B2 * 7/2009 Zamalis et al. ..... 138/46
2006/0102359 A1 * 5/2006 Brown et al. ..... 166/379

* cited by examiner

*Primary Examiner* — Eric Keasel
*Assistant Examiner* — Matthew W Jellett
(74) *Attorney, Agent, or Firm* — GE Global Patent Operation

(57) ABSTRACT

A packing unit to seal a wellbore, the packing unit including at least one rotatable cam having a cam axis disposed about an axis of the wellbore, wherein the at least one rotatable cam is rotatable about the cam axis, the at least one rotatable cam comprising a seal recess formed in an outer periphery of the at least one rotatable cam, wherein the packing unit sealingly engages a tool in the wellbore by rotation of the at least one rotatable cam, bringing the seal recess into sealing contact with the tool.

14 Claims, 11 Drawing Sheets

Figure 5
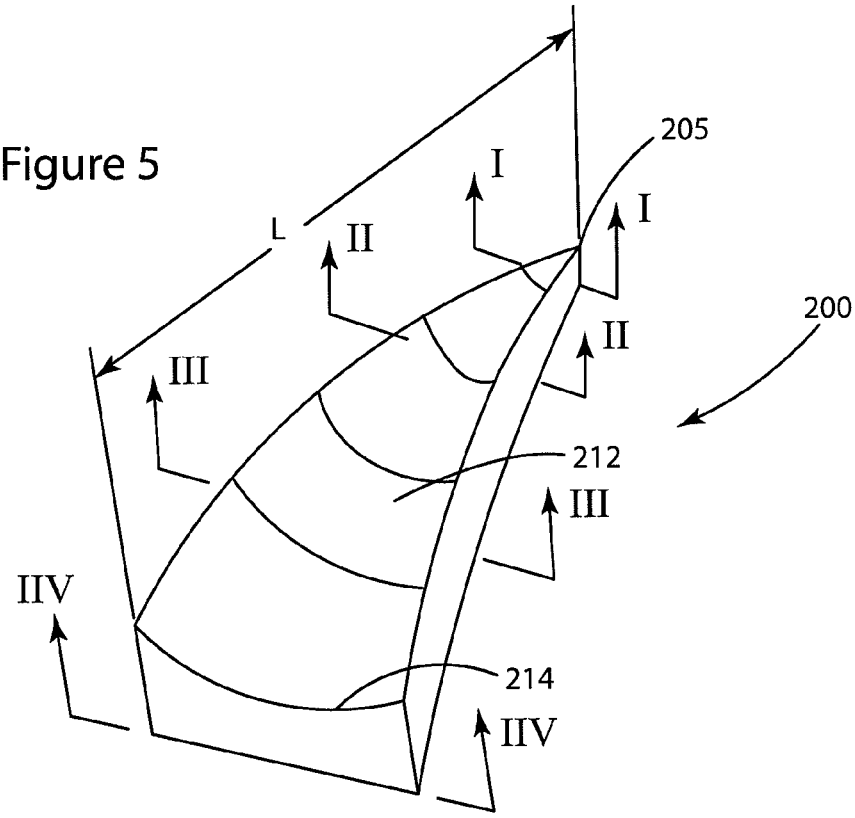
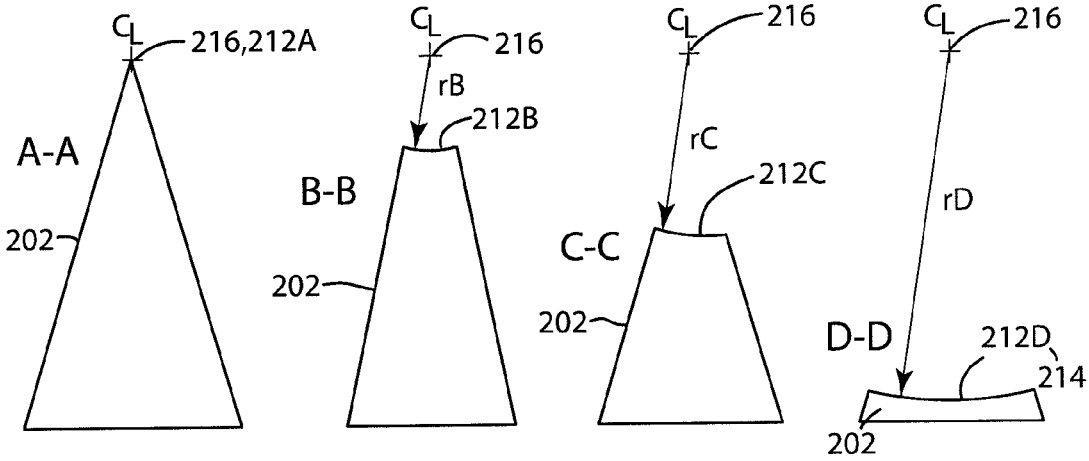
Figure 5A Figure 5B Figure 5C Figure 5D

VARIABLE RADIUS ANNULAR AND RAM PACKING UNIT AND METHOD

BACKGROUND

1. Field of the Disclosure

Embodiments disclosed herein relate generally to well control devices used in oil and gas exploration. In particular, embodiments disclosed herein relate to packing units capable of sealing varying tubular diameters in a wellbore.

2. Background Art

Referring initially to FIG. 1, a prior art annular blowout preventer 101 is shown. Annular blowout preventer 101 includes a housing 102 having a central bore 120 extending therethrough along a borehole axis 103. A packing unit 105 is disposed within annular blowout preventer 101 about central bore 120, such that a bore 111 of the packing unit 105 is substantially concentric with bore 120 of blowout preventer 101.

As depicted in FIG. 1, packing unit 105 includes an elastomeric annular body 107 and a plurality of metal inserts 109. Metal inserts 109 are shown disposed within elastomeric annular body 107 of packing unit 105 in radial planes in a generally circular fashion about borehole axis 103. In use, hydraulic fluid may enter a cylinder 112 through an activation port 113, thereby thrusting an actuation piston 117 in an upward direction. As piston 117 is thrust upward, an inclined surface 118 of actuation piston 117 compresses packing unit 105 so that bore 111 is reduced as metal inserts 109 are displaced toward borehole axis 103. To open bore 111, hydraulic fluid is diverted to a retraction port 115 and piston 117 is urged in a downward direction.

Thus, conventional packing units (e.g., 105) generally include large toroid-shaped elastomeric (or rubber) seal devices that may not be able to withstand the elevated temperatures and pressures encountered in various drilling situations. As wells are drilled deeper into the earth and in deeper waters offshore, the temperatures and pressures of returning drilling fluids are increasing to levels exceeding those previously experienced. As a result, elastomers that were flexible enough to be used in former packing units may soften too severely under the higher temperatures and therefore may lose their ability resist failure by extrusion through the large "gap" in the annular space between inclined surface 118 and bore 120.

Additionally, metal inserts 109, historically disposed within the elastomeric body 107 to strengthen the packing unit 105, may not be able to provide sufficient structural support to prevent the elastomeric body 107 from failing at the elevated temperatures and pressures experienced in such deep well drilling environments. While elastomers capable of exhibiting suitable high-temperature resistance may be available, such elastomers are too stiff at lower temperatures to be usable in packing units. When used at lower temperatures, the stiffer, high-temperature, elastomers may not be able to sufficiently deform to seal about a tubular or other object contained within bore 120.

Therefore, for annular packing units to function properly (i.e., form stable seals between the bore 120 and an object contained within the bore 120) in wells having high temperature and pressure, packing units must maintain an appropriate amount of flexibility yet retain sufficient strength across the entire anticipated operating range of temperatures and pressures. In certain high-temperature applications, absent the development of new elastomer compounds, interchangeable (or multiple) packer elements, each having a elastomer combination tailored for a particular sub-set of the overall temperature and pressure range, would be necessary. However, as many high-temperature and high-pressure drilling applications occur at deep sea depths, the ability to deploy a system using interchangeable packer elements is limited.

Therefore, an improved mechanism for a packing unit of an annular and/or a ram-type blowout preventer would be highly desirable. For example, if an annular blowout preventer were constructed with a packing element capable of accommodating a range of sizes without experiencing significant strains, the pressure and temperature ratings of the annular blowout preventer may be increased and one or more ram-type blowout preventers removed from the BOP stack.

Accordingly, there exists a need for a robust packing element capable of withstanding elevated temperatures and pressures, while simultaneously providing adequate sealing capabilities about a variety of objects of varying size.

SUMMARY OF THE DISCLOSURE

In one aspect, embodiments disclosed herein relate to a packing unit to seal a wellbore, the packing unit including, at least one rotatable cam having a cam axis disposed about an axis of the wellbore, wherein the at least one rotatable cam is rotatable about the cam axis, the at least one rotatable cam comprising a seal recess formed in an outer periphery of the at least one rotatable cam, wherein the packing unit sealingly engages a tool in the wellbore by rotation of the at least one rotatable cam, bringing the seal recess into sealing contact with the tool.

In another aspect, embodiments disclosed herein relate to a blowout preventer, including a main body having a wellbore axis defined therethrough, a packing unit disposed within the main body and configured to seal the wellbore, wherein the packing unit including, at least one rotatable cam having a cam axis, wherein the rotatable cam is rotatable between at least a first rotary position and a second rotary position, the at least one rotatable cam comprising a seal recess formed in an outer periphery of the at least one rotatable cam, the seal recess configured to seal against a minimum radius when the at least one rotatable cam is in the first rotary position, the seal recess configured to seal against a maximum radius when the at least one rotatable cam is in the second rotary position, and the seal recess comprising a taper between the first and the second rotary positions, the taper configured to seal against a range of radii between the minimum radius and the maximum radius as the at least one rotatable cam is rotated about the cam axis between the first and second rotary positions.

In another aspect, embodiments disclosed herein relate to a packing unit to seal a wellbore, the packing unit including at least one arc segment disposed about an axis of the wellbore, wherein the at least one cam is disposed within an arc guide, the at least one arc segment comprising a seal recess formed in an outer periphery of the at least one arc segment, wherein the packing unit sealingly engages a tool in the wellbore by moving the at least one arc segment within the arc guide, bringing the seal recess into sealing contact with the tool.

In another aspect, embodiments disclosed herein relate to a method to seal a wellbore, the method including disposing at least one cam about an axis of the wellbore, wherein of the at least one cam is rotatable about a cam axis between at least a first rotary position and a second rotary position, engaging a tubular member with a seal recess formed in an outer periphery of the at least one cam, wherein the at least one engaged cam comprises a seal radius corresponding to an outer diameter of the tubular member when the at least one cam is at a rotary position between the at least first and the second rotary positions, forming a seal against the tubular with the seal recess of the at least one cam.

The above brief description sets forth features of the various embodiments of the present invention in order that the detailed description that follows may be better understood, and in order that the present contributions to the art may be better appreciated. There are, of course, other features of the invention that will be described hereinafter and which will be for the subject matter of the appended claims.

In this respect, before explaining several embodiments of the invention in detail, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

Further, the purpose of the foregoing Abstract is to enable a patent examiner and/or the public generally, and especially scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

Other aspects and advantages of the invention will be apparent from the following description and the appended claims.

BRIEF DESCRIPTION OF DRAWINGS

Features of the present disclosure will become more apparent from the following description in conjunction with the accompanying drawings.

FIG. 5 is a profiled view of a tapered seal recess sectioned from an outer periphery of a cam in accordance with embodiments of the present disclosure.

FIG. 5A is a section-view drawing of the tapered seal recess of FIG. 5 taken along a line I-I.

FIG. 5B is a section-view drawing of the tapered seal recess of FIG. 5 taken along a line II-II FIG. 5C is a section-view drawing of the tapered seal recess of FIG. 5 taken along a line III-III.

FIG. 5D is a section-view drawing of the tapered seal recess of FIG. 5 taken along a line IV-IV.

DETAILED DESCRIPTION

Embodiments disclosed herein relate to packing units including rotatable rigid cams to seal a wellbore. Typical prior art packing units ("conventional") create seals through large deformations in elastomers. In contrast, packing units in accordance with embodiments disclosed herein incorporate rigid cams rotatable to form seals against objects of various diameters disposed within a bore of the packing unit.

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a gas turbine connected to a generator to form a plant assembly on a barge. However, the embodiments to be discussed next are not limited to these systems, but may be applied to other plant assemblies that include heavy devices that require easy and safe access and also a good alignment among the various devices. The exemplary embodiments also apply to devices that are located on the ground.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
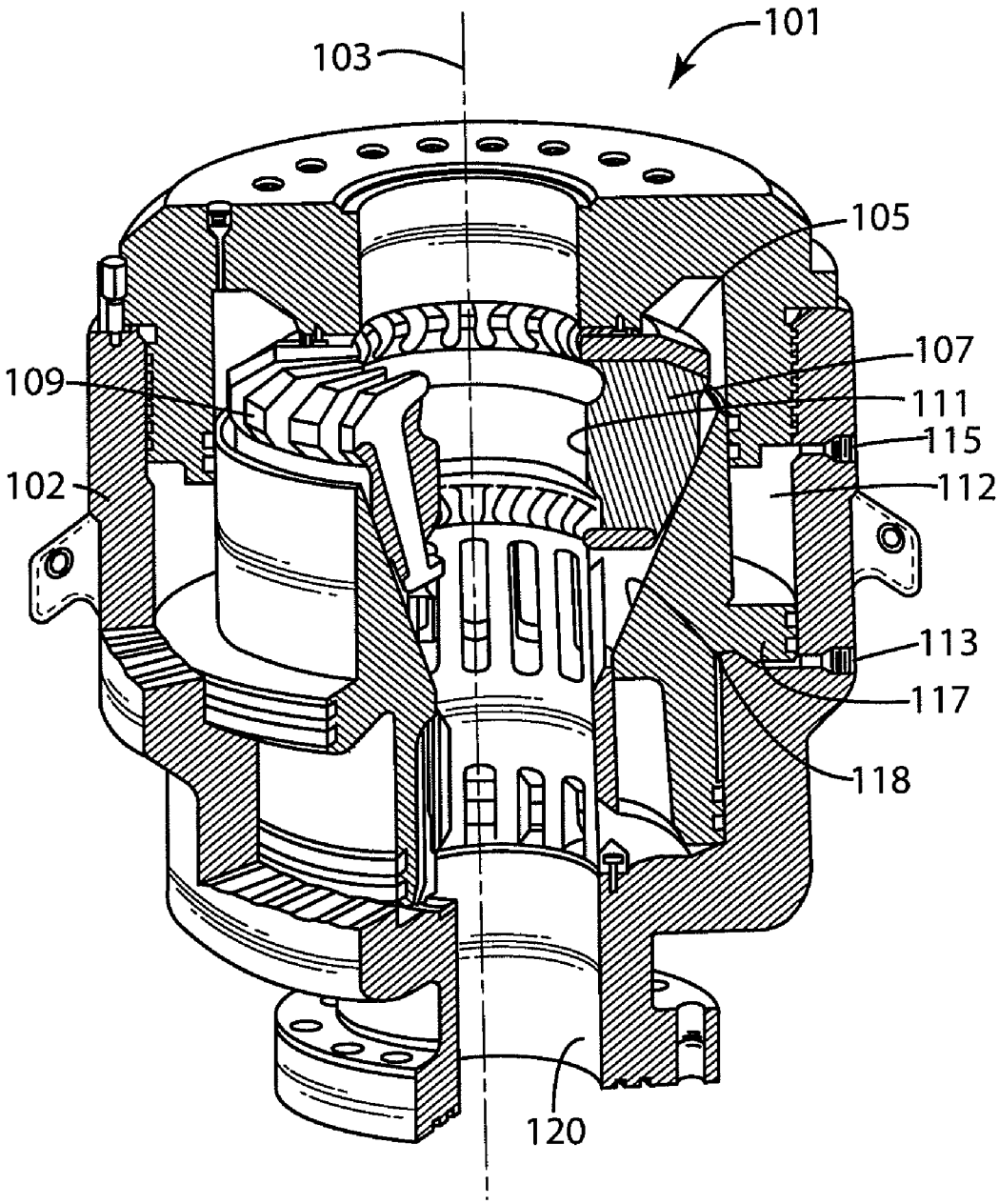
Figure 1 Prior Art
FIG. 1 is a cross-sectional profiled view of a conventional annular-type blowout preventer.
Figure 2A:
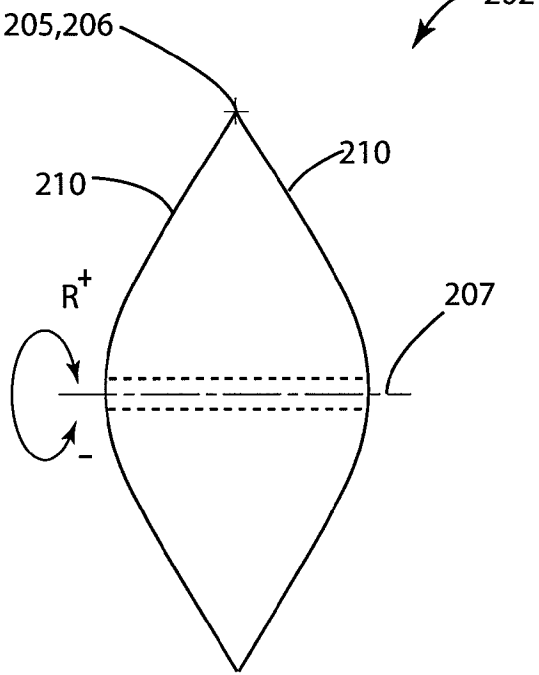
FIGS. 2 and 2A are schematic representations of a packing unit in accordance with embodiments of the present disclosure depicted in a fully-closed position.
Figure 2:
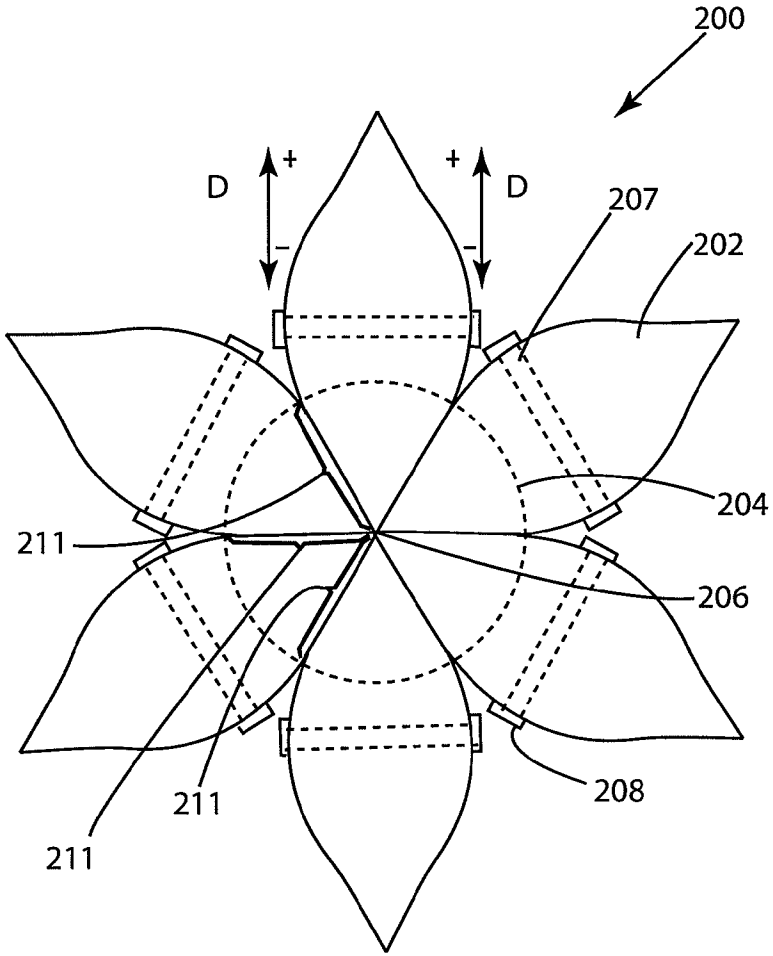
Figure 3A:
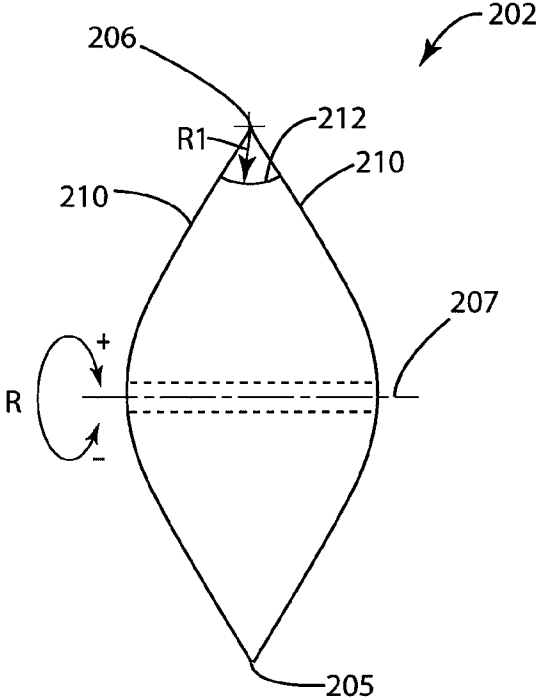
FIGS. 3 and 3A are schematic representations of the packing unit of FIGS. 2 and 2A depicted in a partially-open position.
Figure 3:
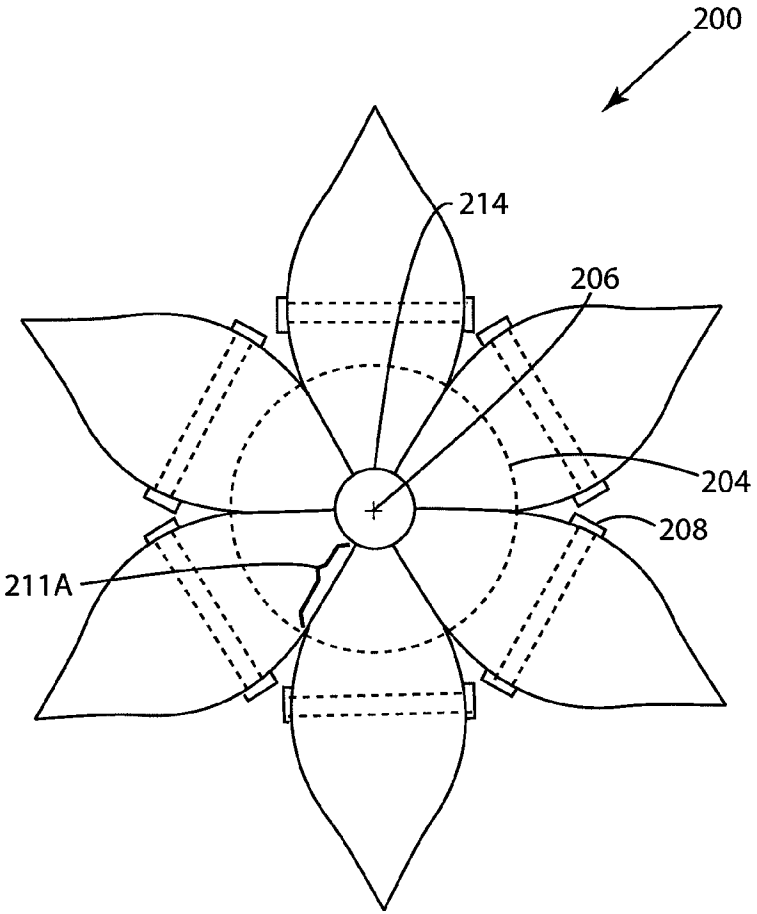
Figure 4A:
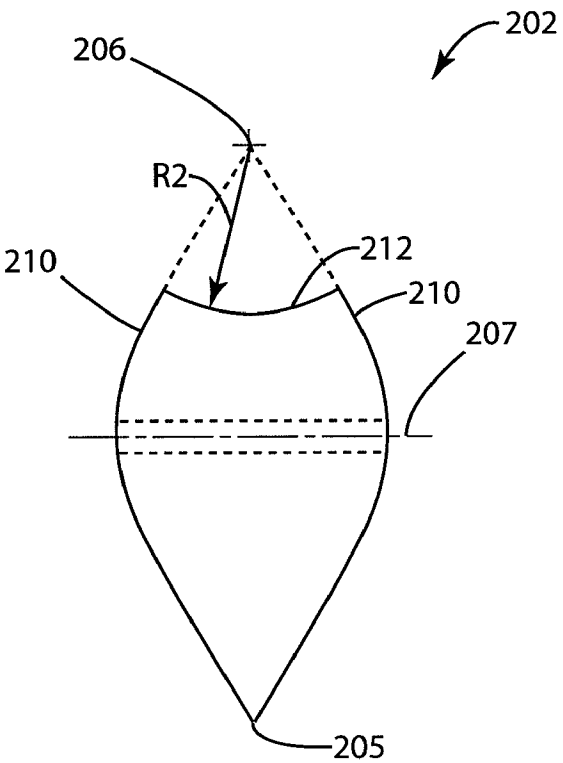
FIGS. 4 and 4A are schematic representations of the packing unit of FIGS. 2 and 2A depicted in a fully-open position.
Figure 4:
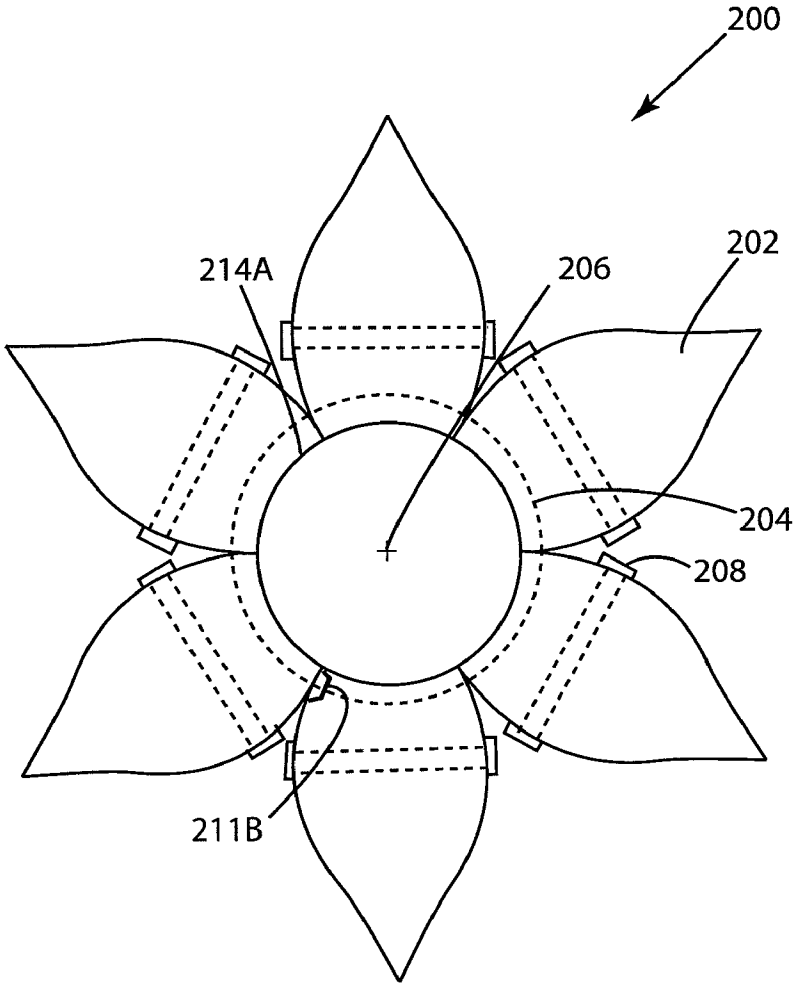

Referring generally to FIGS. 2-4 (including FIGS. 2A, 3A, and 4A) together, a schematic representation of an alternative packing unit 200 in accordance with embodiments of the present disclosure is shown in closed (FIG. 2), partially open (FIG. 3), and fully open (FIG. 4) positions. In each FIGS. (2, 3, and 4), packing unit 200 is configured to seal a bore 204 (e.g., a wellbore) having a wellbore axis 206 generally perpendicular to the plane of the drawing surface of each figure. Using a plurality of rotatable cams 202, packing unit 200 is capable of isolating a relatively high pressure zone of wellbore 204 located below packing unit 200 from a relatively low pressure zone of wellbore 204 located above packing unit 200. While six cams 202 are shown in packing unit 200, it should be understood that fewer or additional cams may be used to perform the sealing function of packing unit 200 without departing from the scope of the present disclosure.

As shown in FIGS. 2, 3, and 4, packing unit 200 is capable of sealing wellbore 204 when no objects are disposed therethrough (FIG. 2), when small diameter objects are engaged through packing unit 200 (FIG. 3), and when large diameter objects are engaged through packing unit 200 (FIG. 4). Furthermore, as described in more detail below, packing unit 200 may be configured to seal about objects of infinitely variable size within a specified range.

Referring specifically to FIGS. 2 and 2A together, packing unit 200 is shown in a closed position with no objects extending therethrough along wellbore axis 206. FIG. 2 depicts a packing unit 200 assembly in the closed position and FIG. 2A depicts a single cam 202 from packing unit 200 of FIG. 2. Each cam 202 may be configured to rotate about a cam axis 207 defined by an axle 208 extending through the center of each cam 202. In the closed position shown in FIGS. 2 and 2A, an outer peripheral surface 210 of each cam 202 comprises a conical point 205 such that cams 202 of packing unit 200 meet together at a plurality of lines of contact 211 between adjacent cams 202. As lines of contact 211 extend from conical point 205 (at wellbore axis 206) to a location beyond wellbore 204, cams 202 of packing unit 200 may substantially seal off bore 204.

In certain embodiments, cams 202 may be manufactured of a rigid, wear-resistant, metallic material (e.g., steel, brass, tungsten, etc.) capable of withstanding significant loads without deforming. As such, cams 202 of packing unit 200 may function to create a plurality of metal-to-metal seals along lines of contact 211, thereby preventing fluids in the wellbore 204 from bypassing packing unit 200 from a high pressure region to low pressure region. Alternatively, in other embodiments, cams 202 may be manufactured of a rigid, metallic material as described above, but with the addition of a relatively thin coating of a relatively soft elastomer (or natural rubber) material applied thereupon. As such, the rigid base material of cams 202 may provide the structural rigidity necessary to form a fluid-tight seal while the relatively soft elastomer material may permit the otherwise rigid member to "give" slightly in order to accommodate objects and impurities in the fluids that might otherwise compromise a strict, metal-to-metal seal. The thin coating of elastomer may be applied on the cam so that a smooth, continuous layer of elastomer is formed thereon. In certain embodiments, the thickness of the coating may not exceed approximately 12.7 mm (0.5 in). Alternatively still, in additional embodiments, cams 202 may be constructed entirely of hardened rubber or elastomer materials so as to have the ability to seal on varying geometries and exhibit increased wear-resistance as objects (e.g., drill pipe, measurement tools, casing strings, etc.) are "stripped" through packing unit 200 under pressure from wellbore 204.

Figure 2B:
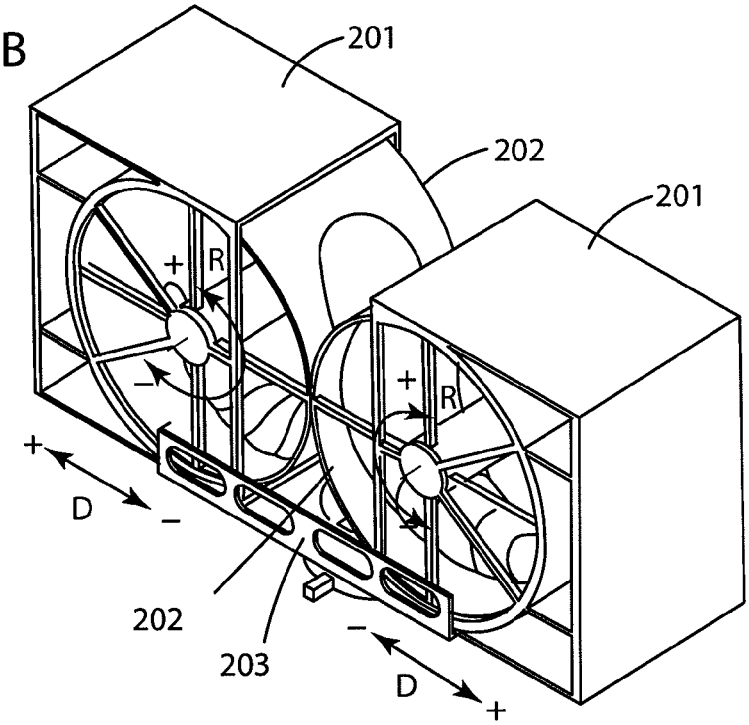
FIGS. 2B-2D are assembly views of a packing unit capable of lateral movement in accordance with embodiments of the present disclosure.
Figure 2C:
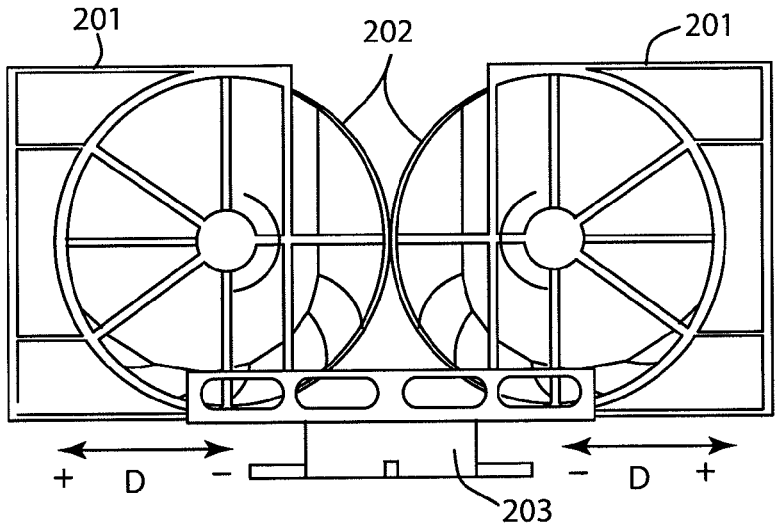
Figure 2D:
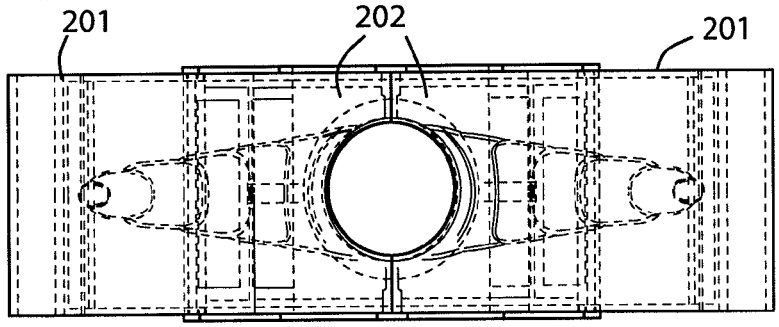

Referring still to FIGS. 2 and 2A, in order to effect the sealing arrangement of the plurality of cams 202 of packing unit 200, one or more of the plurality of cams 202 may be rotated about their respective cam axes 207 in a positive (+) or negative (−) R direction and/or thrust laterally toward wellbore 204 (i.e., radially toward wellbore axis 206) in a negative (−) D direction. Such rotation and thrusting of cams 202 may be accomplished by any mechanism known to those having ordinary skill in the art, including, but not limited to, hydraulic, mechanical (i.e., rack and pinion geared), and electrical drive mechanisms. One such mechanism is shown in FIGS. 2B-2D in accordance with embodiments of the present disclosure. The cams 202 may rotated in the positive (+) or negative (−) R direction within blocks 201. Additionally, the blocks 201 may be thrust laterally in a negative (−) D direction (i.e., toward the wellbore) or in a positive (+) D direction. The blocks 201 may be slidably attached to a stand 203, which is further attached to a body of a blowout preventer. In one embodiment, the cams 202 may be rotated equally (i.e., cams 202 are rotated the same amount to seal on a single diameter) by having intermeshing splines or gear teeth between the multiple cams 202. In other words, the cams 202 may be linked through the intermeshing splines or gear teeth (not shown), such that the cams 202 are rotated dependently (i.e., when one cam is rotated, the remaining cams rotate the same). Alternative mechanisms for synchronously moving/actuating the cams may be used without departing from the scope of the embodiments disclosed herein.

As would be understood by those having ordinary skill, additional thrusting of cams 202 in the negative (−) D direction may enhance the sealability along lines of contact 211, particularly when outer peripheries 210 of cams 202 comprise elastomeric materials. Furthermore, one of ordinary skill will appreciate that cams 202 may be thrust in a positive (+) D direction to allow objects to pass packing unit 200 without obstruction. In some embodiments, cams 202 may be displaced in the positive (+) D direction far enough to allow the entire wellbore 204 to be accessed without interference from packing unit 200.

Referring briefly to FIGS. 3 and 3A, packing unit 200 is shown in a partially-open position sealing about a generally tubular object 214 extending through wellbore axis 206. As shown, the outer periphery 210 of each cam 202 of packing unit 200 includes, at each given angular position for some embodiments, a seal recess 212 having a radius R1. Seal recess 212 generally corresponds to an outer profile of tubular object 214 such that when all cams 202 engage tubular object 214, sealing engagement occurs at lines of contact 211A extending from the outer periphery of object 214 to a point beyond wellbore 204 diameter.

Referring briefly now to FIGS. 4 and 4A, packing unit 200 is shown in a fully-open position sealing about a larger generally tubular object 214A extending through wellbore axis 206. As shown, the outer periphery 210 of each cam 202 of packing unit 200 includes seal recess 212 having a radius R2. Seal recess 212 generally corresponds to the outer profile of larger tubular object 214A such that when all cams 202 engage tubular object 214, sealing engagement occurs at lines of contact 211B extending from the outer periphery of larger tubular object 214A to a point beyond wellbore 204 diameter.

Referring now to FIGS. 2-4A together, in certain embodiments, the outer periphery 210 of each cam 202 may include a tapered seal recess 212 that gradually transforms from the conical point 205 (i.e., a radius of zero) shown in FIG. 2 to the circular seal recess 212 (e.g., having radii R1 and R2) shown in FIGS. 3 and 4 as cams 202 are rotated about axis 207 in either the positive or the negative R direction. The rate of change of the radii in tapered seal recess 212 (as cams 202 are rotated about axis 207) may be any mathematical relation including, but not limited to, linear, non-linear, logarithmic, and exponential relationships. Additionally, a finite series of radii in succession may form the tapered seal recess 212.

As such, depending on an amount of rotation in direction R, cams 202 of packing unit 200 may seal against a range of tubular object sizes (e.g., 214, 214A, etc.) extending between a minimum diameter (e.g., the "zero" radius of FIG. 2) to a maximum diameter (e.g., the fully-open position of FIG. 4). Thus, in certain embodiments, packing unit 200 is alternatively capable of sealing either wellbore 204 alone or an annular space between a wellbore 204 and an array of tubular objects (214, 214A) of various outer diameters (e.g., R1, R2, etc.).

Therefore, in embodiments having a tapered seal recess 212, the closed (FIG. 2), partially open (FIG. 3), and fully open (FIG. 4) positions for packing unit 200 shown in FIGS. 2-4A depict a single packing unit 200 configured to sealingly engage wellbore 204 when no object is contained within wellbore 204 or when objects ranging in size up to radius R2 are contained within wellbore 204. As such, outer periphery 210 of cams 202 may taper from a zero-radius conical point 205 to a mid radius RI seal recess 212 to a large radius R2 seal recess 212 as cams 202 are rotated about cam axis 207 in either the positive or negative direction R.

Figure 4C:
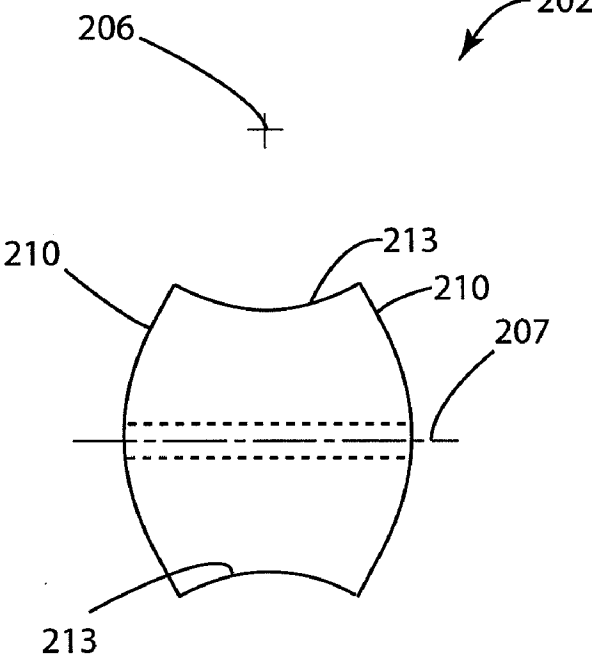
FIGS. 4B and 4C are schematic representations of an alternate packing unit with cams having a zero-tapered configuration.
Figure 4B:
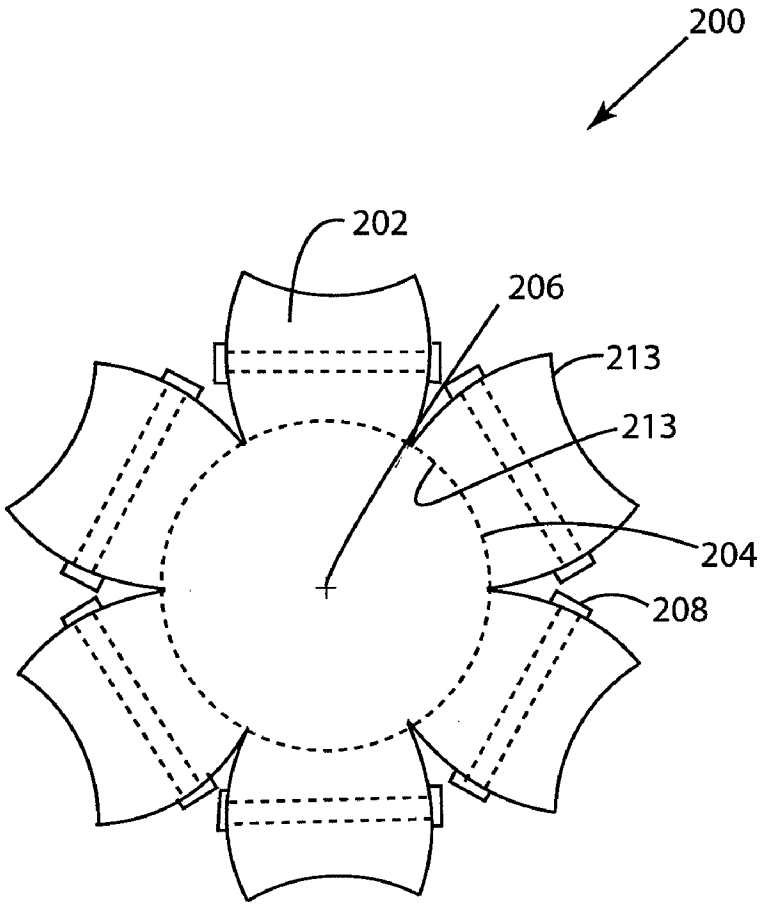
Figure 6A:
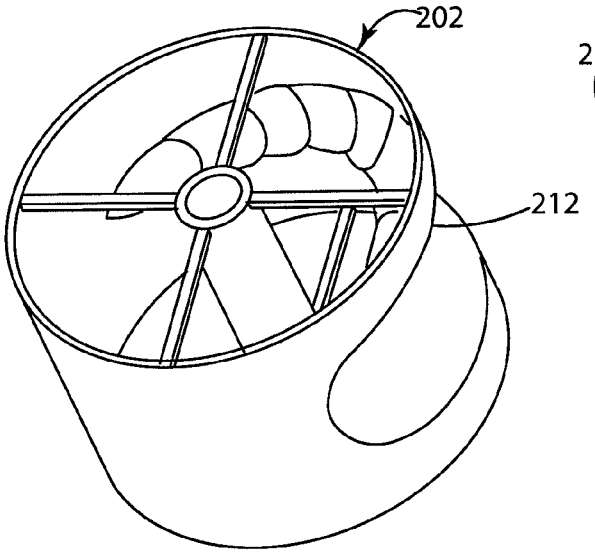
FIGS. 6A-6D show views of a cam having a tapered seal recess therein in accordance with embodiments of the present disclosure.
Figure 6B:
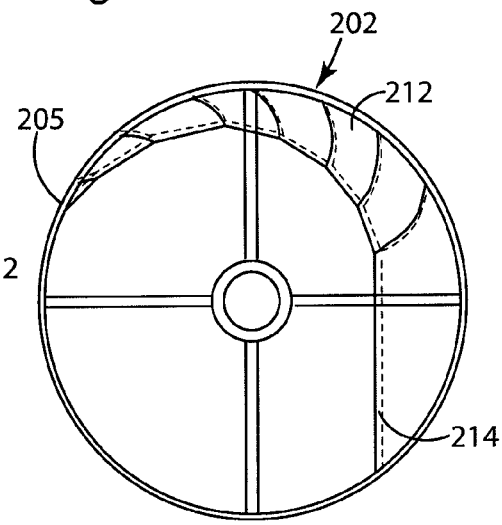
Figure 6C:
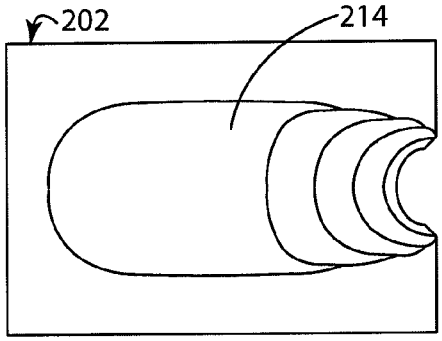
Figure 6D:
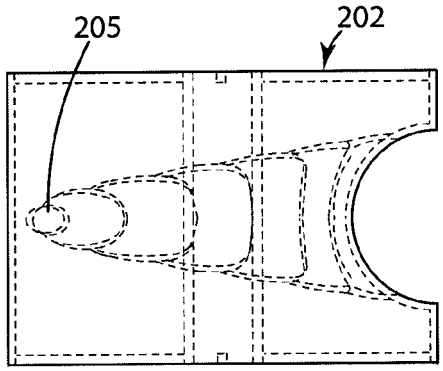

In alternative embodiments, as shown in FIGS. 4B and 4C, a "zero-tapered" seal recess 213 may be formed in the cams 202 of the packing unit 200. The zero-tapered seal recess 213 of packing unit 200 may include a minimum diameter that is the same as the maximum diameter such that the angle of taper in recess 212 is zero. In such a "zero-tapered" configuration, either a conical point (205 in FIG. 3A) or a constant radius (e.g., R1, R2 in FIGS. 3A and 4A) may by exposed toward wellbore axis 206 regardless of the angular position of cams 202 about their respective cam axes 207. Cams 202 having such zero-tapered seal recesses 213 upon outer peripheries 210 may be advantageous, in certain applications, for sealing against items (i.e., drill pipe) of a known constant diameter as they are entered into (i.e., tripped in) or withdrawn from (i.e., tripped out) a pressurized wellbore 204. Additionally, it should be understood that seal recesses 213 may be of geometric profiles other than circular segments (e.g., R1, R2), including, but not limited to, polygonal and elliptical profiles.

Referring now to FIG. 5, an example of a tapered seal recess 212 in accordance with embodiments of the present disclosure is shown in a schematic profile view. Tapered seal recess 212 is depicted in FIG. 5 as an arcuate section from an outer periphery 210 of cams 202 similar to those depicted in FIGS. 2-4A. As shown in FIG. 5, tapered seal recess 212 may begin at a minimum radius 205 (e.g., radius=zero) and may extend along an arcuate length L until a maximum radius 214 of tapered seal recess 212 is achieved. Section lines I-I, II-II, III-III, and IV-IV of FIG. 5 indicate cross-sectional views depicted in FIGS. 5A, 5B, 5C, and 5D, respectively.

Referring initially to FIG. 5A, corresponding to line I-I of FIG. 5, a seal recess 212A of outer periphery 210 of cam 202 is shown to be a full conical point (i.e., radius=zero or no radius) at minimum radius 205. Thus, seal recess portion 212A of section I-I of full tapered seal recess 212 intersects with wellbore axis 206 (FIGS. 2, 3, and 4) and may sealingly engage corresponding seal recesses 212A of other cams 202 with no objects disposed in wellbore 204.

Next, referring briefly to FIG. 5B, corresponding to section line II-II of FIG. 5, a seal recess 212B of outer periphery of cam 202 is shown having an intermediate radius RB. Thus, seal recess portion 212B of section II-II of tapered seal recess 212 may optimally sealingly engage with corresponding seal recesses 212B of other cams 202 about a tubular object having a radius RB. Additionally, referring similarly to FIG. 5C, a seal recess 212C may have a radius RC. Finally, referring to FIG. 5D, a seal recess 212D (equivalent to maximum radius 214) may have a radius RD. Thus, tapered seal recess 212 of FIG. 5 may be used to seal wellbore 204 when objects of radius zero (i.e. no object), radius RB, radius RC, and radius RD (and all radii therebetween) are disposed within wellbore 204 and through packing unit 200.

Referring now to FIGS. 6A-6D, a cam 202 having the tapered seal recess 212 is shown in accordance with embodiments of the present disclosure. As described above, tapered seal recess 212 begins at a minimum radius 205 (e.g., radius=zero) and may extend along an outer circumference of the cam until a maximum radius 214 of the tapered seal recess 212 is achieved.

Figure 7:
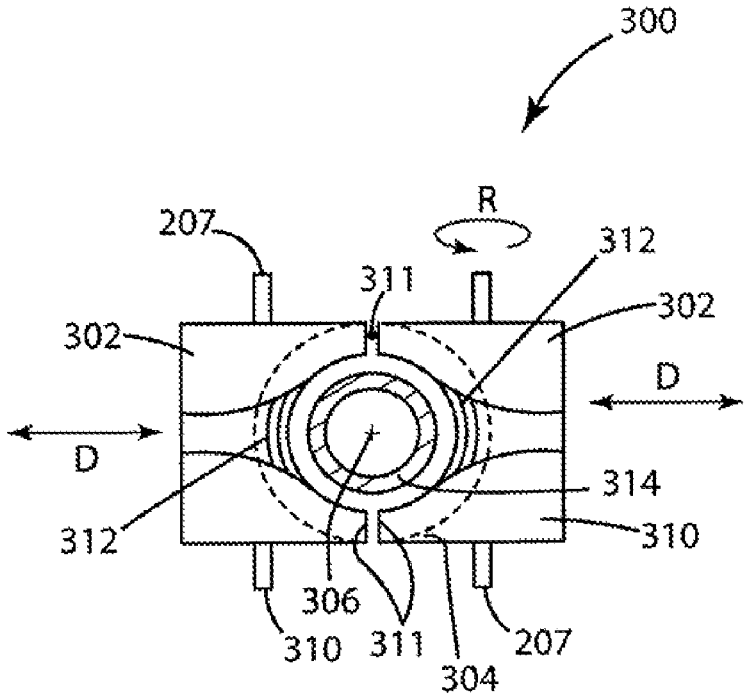
FIGS. 7 and 7A are schematic representations of an alternate packing unit in accordance with embodiments of the present disclosure.
Figure 7A:
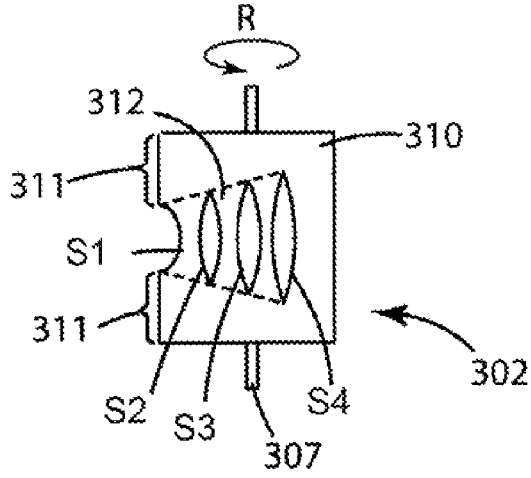

Now referring to FIGS. 7 and 7A, an alternative packing unit 300 in compliance with embodiments of the present disclosure is shown. In particular, alternative packing unit 300 is shown having two cams 302, each comprising a seal recess 312 formed in an outer periphery 310 of the cam 302. As with packing unit 200 described above in FIGS. 2-5D, cams 302 of packing unit 300 are able to rotate about axes 207 in a positive or negative direction R. As cams 302 are rotated about axes 207, differing radii of seal recess 312 are presented for sealing against a tubular object 314 located in a wellbore 306. Additionally, outer peripheries 310 of cams 302 will intersect and seal against each other at sealing lines 311.

Thus, as cams 302 are translated in a direction D and rotated about axes 307 such that an appropriate seal radius of seal recess 312 is positioned against tubular object 314, packing unit 300 may effectively seal an annular space between a wellbore 304 and an outer profile of tubular object 314 disposed within wellbore 304. Furthermore, as shown in FIG. 7A, tapered seal recess 312 of each cam 302 may comprise a continuous range of seal radii, including S1, S2, S3, and S4, so that a variety of sizes of tubular objects 314 may be sealingly engaged by packing unit 300. As packing unit 300 may be constructed having two horizontally-opposed cams 302, packing unit 300 may, in some embodiments, be used in a ram-type blowout preventer to seal a variety of tubular sizes (e.g., S1, S2, S3, and S4) disposed therethrough.

Figure 8A:
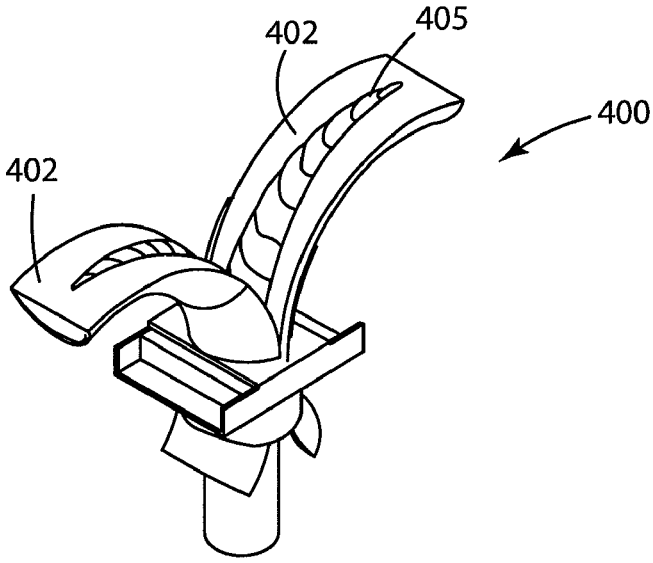
FIGS. 8A-8C are assembly views of a packing unit having two arc segments in accordance with embodiments of the present disclosure.
Figure 8B:
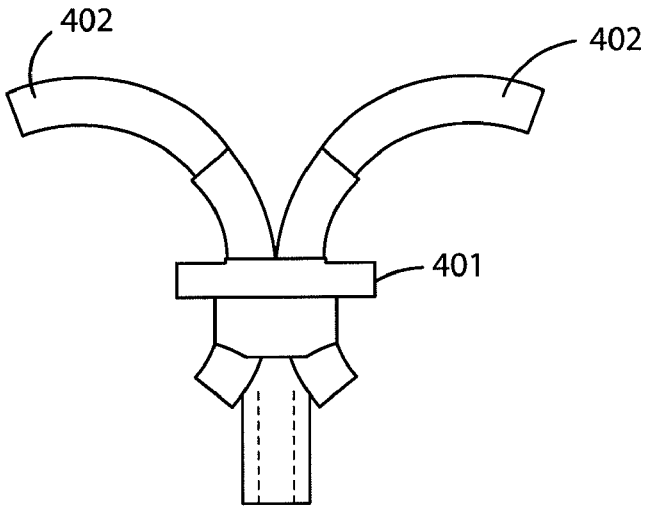
Figure 8C:
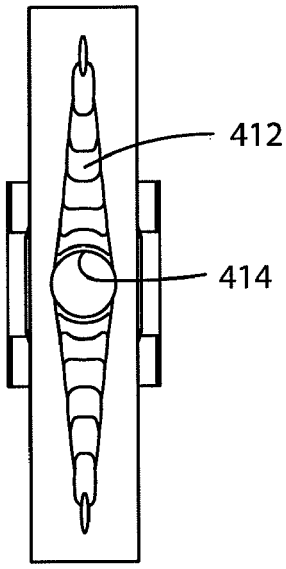

Referring to FIGS. 8A-8C, a variable radius annular packing unit 400 is shown in accordance with alternate embodiments of the present disclosure. The packing unit 400 includes an arc guide 401 in which two arc segments 402 are disposed. The arc guide 401 is configured to maintain a proper alignment of the arc segments 402. The arc segments 402 have a tapered seal recess 412 that extends along a length of the arc segments 402 from a minimum radius 405 (zero radius) to a maximum radius 414. The arc segments 402 may move within the arc guide 401, while the arc guide 401 remains fixed to the blowout preventer (not shown), so that the tapered seal recess 412 may seal against tubular of different diameters. The arc segments 402 may be moved (i.e., moved up and down in a reciprocable manner) within the arc guide by a hydraulic, mechanical (rack and pinion system), or electrical drive system.

Alternatively, the arc guide 402 may be configured to move axially (i.e., up and down) within a bore of the blowout preventer, while the arc segments 402 remain in once place, to move the tapered seal recess 412 into sealing engagement with the tubular disposed therethrough. The arc guide 402 may be translated axially within the bore by a hydraulic, mechanical, or electrical system. Still further, a combination of movement of the arc segments 402 within the arc guide 401 and axial movement of the arc guide 401 within the bore of the blowout preventer may be used to adjust and move the arc segments 402 within the arc guide 401.

Figure 9A:
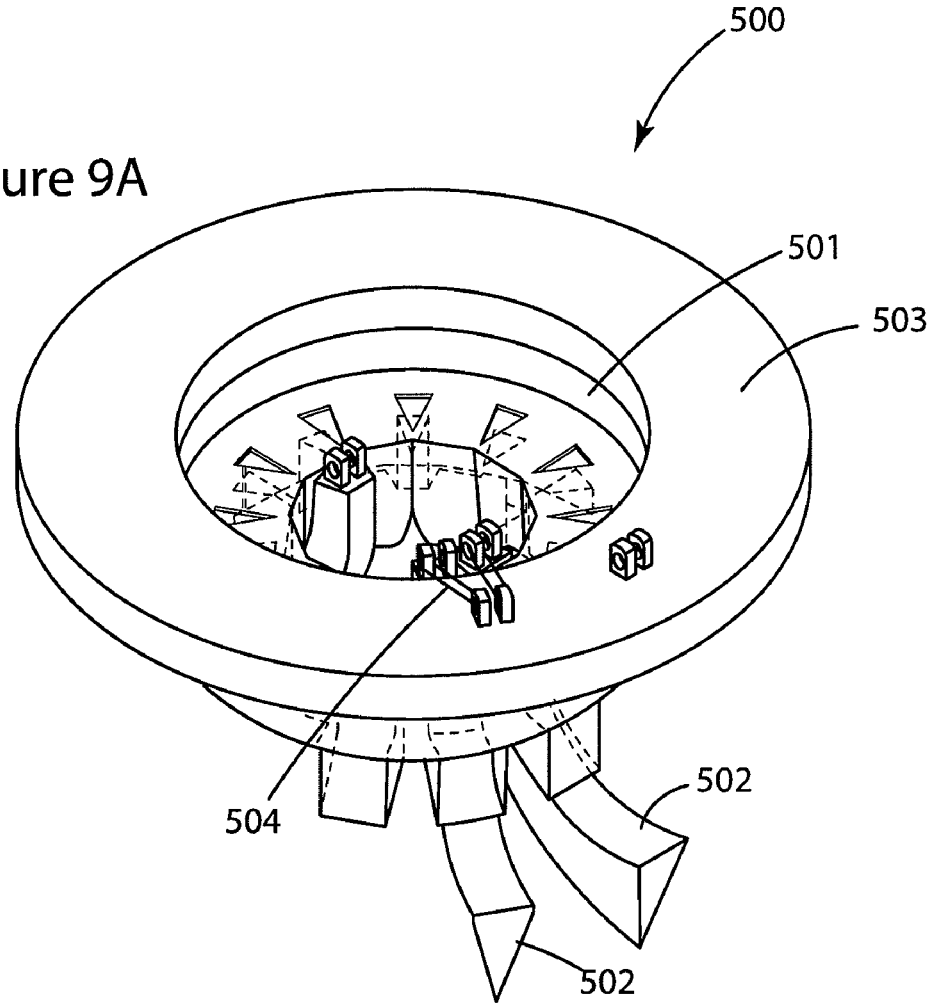
FIGS. 9A and 9B are assembly views of a packing unit having a lift plate for movement of multiple arc segments in accordance with embodiments of the present disclosure.
Figure 9B:
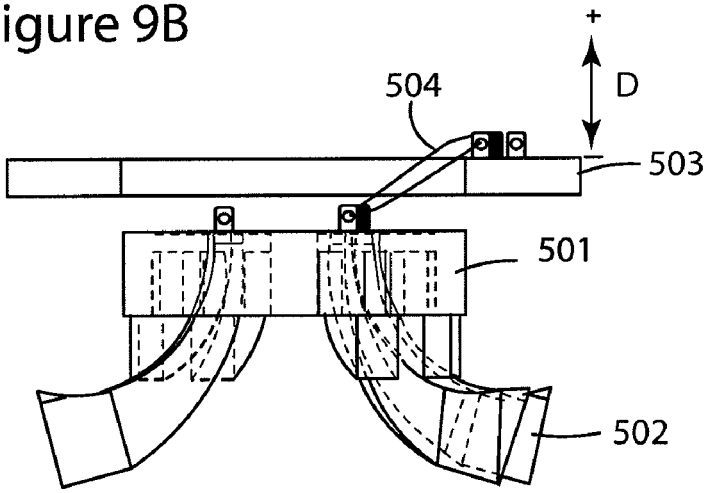

Now referring to FIGS. 9A and 9B, a variable radius annular packing unit 500 is shown in accordance with alternate embodiments of the present disclosure. The packing unit 500 includes multiple arc segments 502 (e.g., 12 arc segments), disposed within an arc guide 501 configured to maintain proper alignment of the arc segments 502. The arc guide 501 may include grooves (not shown) in which the arc segments 502 are aligned. The arc segments 502 have a tapered seal recess (e.g., 212 shown in FIG. 5) formed along a length of the arc segments 502 that is configured to contact and seal about different diameter tubulars in the wellbore. Further, the packing unit 500 includes a lift plate 503 that is connected to each arc segment 502 through a linkage device 504. The linkage device 504 may be a metal bar or any other linkage device as known to one of ordinary skill in the art.

In certain embodiments, the arc guide 501 may be fixed within a blowout preventer (not shown), while the lift plate 503 may be moved axially (i.e., up and down) within the bore of the blowout preventer. The lift plate 503 may be moved in a positive (+) or negative (−) direction D within the bore by a hydraulic, mechanical, or electrical system. Therefore, through the linkage device 504 connected between the lift plate 503 and the arc segments 502, movement of the lift plate 503 (up or down) may force the arc segments 502 to move up or down to seal about different diameter tubular.

In general, embodiments disclosed herein employ similar methods to seal a wellbore. Initially, a plurality of cams may be positioned about an axis of the wellbore. Each of the plurality of cams is rotatable about a cam axis between a first rotary position and a second rotary position. Next, the plurality of cams may engage a tubular member with seal recesses formed in outer peripheries of each of the plurality of cams. Each of the plurality of engaged cams includes a seal radius corresponding to an outer diameter of the tubular member when the cams are at a rotary position between the first and the second rotary positions. Finally, a seal is formed against the tubular with each of the seal recesses of the plurality of cams and between the outer periphery of each pair of adjacent cams of the plurality of cams.

Advantageously, embodiments of the present disclosure provide packing units that are capable of withstanding the rigors of elevated temperature and pressure service longer and more durably than former annular packing unit designs. In particular, certain embodiments of the present disclosure disclose packing units including pluralities of rigid cams, rotatable about cam axes, having seal recesses thereupon that are able to sealingly engage each other to form a fluid-tight seal in either an empty wellbore or about a tubular object disposed within the wellbore. In other embodiments, the rotatable cams may have a consistent outer seal recess thereupon so that a single size tubular object may be sealingly engaged as it is removed from or disposed within the wellbore.

Therefore, packing units in accordance with embodiments disclosed herein enable annular seals (e.g., annular blowout preventers) to function across a range of temperatures and pressures at pressures and temperatures not previously possible with former designs. In particular, whereas a single elastomer compound might not be capable of maintaining its structural integrity across a broad temperature and pressure range in a traditional annular blowout preventer seal, the rigid cams disclosed herein will sealingly engage against a variety of tubular sizes without problems typically associated with metal-reinforced elastomer packing unit seals.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments. Finally, in the claims, any means-plus-function clause is intended to cover the structures described herein as performing the recited function and not only structural equivalents, but also equivalent structures.

What is claimed is:

1. A packing unit to seal a wellbore, the packing unit comprising:

at least one rotatable cam disposed about an axis of the wellbore, the at least one rotatable cam having a cam axis and being rotatable about the cam axis, the axis of the wellbore being generally perpendicular to a horizontal plane defined by the cam axis such that rotation of the at least one rotatable cam about the cam axis moves the at least one rotatable cam toward the wellbore and relative to the horizontal plane; and the at least one rotatable cam comprising an outer peripheral surface that includes first surface portion and a second surface portion that is adjacent to the first surface portion, a seal recess defined by the first surface portion and the second surface portion;

wherein the seal recess comprises a taper between at least a first rotary position and a second rotary position, the taper configured to seal against a range of radii between a minimum radius and a maximum radius as the at least one rotatable cam is rotated about the cam axis between the first rotary position and second rotary position: and wherein the packing unit sealingly engages a tool in the wellbore by rotation of the at least one rotatable cam, bringing the seal recess into sealing contact with the tool.

2. The packing unit of claim 1, wherein the seal recess is configured to seal against a second tool comprising a second diameter as the at least one rotatable cam is rotated about the cam axis.

3. The packing unit of claim 1, wherein at least one rotatable cam is configured to move laterally.

4. The packing unit of claim 1, wherein the seal recess comprises an elastomeric coating thereon.

5. The packing unit of claim 1, further comprising two or more rotatable cams.

6. A blowout preventer, comprising:

a main body having a wellbore axis defined therethough;

a packing unit disposed within the main body and configured to seal the wellbore, wherein the packing unit comprises:

at least one rotatable cam disposed about an axis of the wellbore, the at least one rotable cam having a cam axis, the axis of the wellbore being generally perpendicular to a horizontal plane defined by the cam axis such that rotation of the at least one rotatable cam about the cam axis moves the at least one rotatable cam toward the wellbore and relative to the horizontal plane, wherein the at least one rotatable cam is rotatable between at least a first rotary position and a second rotary position;

the at least one rotatable cam comprising an outer peripheral surface that includes a first surface portion and a second surface portion that is adjacent to the first surface portion, a seal recess defined by the first surface portion and the second surface portion;

the seal recess configured to seal against a minimum radius when the at least one rotatable cam is in the first rotary position;

the seal recess configured to seal against a maximum radius when the at least one rotatable cam is in the second rotary position;

the seal recess comprising a taper between the first and the second rotary positions, the taper configured to seal against a range of radii between the minimum radius and the maximum radius as the at least one rotatable cam is rotated about the cam axis between the first and second rotary positions.

7. The blowout preventer of claim 6, wherein the blowout preventer is selected from the group consisting of ram-type blowout preventers and annular blowout preventers.

8. The blowout preventer of claim 6, wherein the seal recess comprises an elastomeric coating thereon.

9. The blowout preventer of claim 6, wherein the minimum radius is zero.

10. The blowout preventer of claim 6, wherein:

the minimum radius and the maximum radius are the same; and the taper is a zero-taper.

11. A method to seal a wellbore, the method comprising,:

disposing at least one rotatable cam about an axis of the wellbore, wherein the at least one rotatable cam is rotatable about a cam axis between at least a first rotary position and a second rotary position, the axis of the wellbore being generallv perpendicular to a horizontal plane defined by the cam axis such that rotation of the at least one rotatable cam about the cam axis moves the at least one rotatable cam toward the wellbore and relative to the horizontal plane, the at least one rotatable cam comprising an outer peripheral surface that includes a first surface portion and a second surface portion that is adjacent to the first surface portion;

engaging a tubular member with a seal recess, defined by the first surface portion and the second surface portion, wherein the at least one engaged cam comprises a seal radius corresponding to an outer diameter of the tubular member when the at least one rotatable cam is at a rotary position between, the at least first and the second rotary positions and wherein the seal recess comprises a taper between the first rotary position and the second rotary position, the taper configured to seal against a range of radii between the radius and the maximum radius as the at least one rotatable cam is rotated about the cam axis between the first rotary position and the second rotary position: and forming a seal against the tubular with the seal recess of the at least one rotatable cam.

12. The method of claim 11, wherein a base material of the at least one rotatable cam is selected from a group consisting of a rigid metal, a hardened elastomer, and a hardened rubber.

13. The method of claim 11, further comprising coating the seal recess with an elastomeric coating.

14. The method of claim 11, further comprising urging the at least one rotatable cam radially against the tubular member to increase the integrity of the seal formed against the tubular.

* * * * *